US007862764B2

(12) United States Patent
Feldman et al.

(10) Patent No.: US 7,862,764 B2
(45) Date of Patent: Jan. 4, 2011

(54) METHOD AND APPLICATOR FOR SELECTIVE ELECTROMAGNETIC DRYING OF CERAMIC-FORMING MIXTURE

(75) Inventors: James Anthony Feldman, Campbell, NY (US); Jacob George, Horseheads, NY (US); Kevin Robert McCann, Horseheads, NY (US); Rebecca Lynn Schulz, Horseheads, NY (US); Gary Graham Squier, Elmira, NY (US); Elizabeth Marie Vileno, Corning, NY (US)

(73) Assignee: Corning Incorporated, Corning, NY (US)

( * ) Notice: Subject to any disclaimer, the term of this patent is extended or adjusted under 35 U.S.C. 154(b) by 27 days.

(21) Appl. No.: 12/079,803

(22) Filed: Mar. 28, 2008

(65) Prior Publication Data

US 2008/0258348 A1 Oct. 23, 2008

Related U.S. Application Data

(60) Provisional application No. 60/921,215, filed on Mar. 30, 2007.

(51) Int. Cl.
*H05B 6/64* (2006.01)

(52) U.S. Cl. ..... 264/430; 264/431; 264/432; 264/631; 264/653

(58) Field of Classification Search ..... 264/430, 264/259, 630, 489, 43, 44, 66, 177.12, 631, 264/639, 653; 34/202; 55/523
See application file for complete search history.

(56) References Cited

U.S. PATENT DOCUMENTS

| | | | | |
|---|---|---|---|---|
| 3,731,036 | A | 5/1973 | Hallier et al. | |
| 3,885,977 | A | 5/1975 | Lachman et al. | 106/62 |
| 4,297,140 | A | 10/1981 | Paisley | 428/310 |
| 4,329,162 | A | 5/1982 | Pitcher, Jr. | 55/523 |
| 4,427,728 | A | 1/1984 | Belmonte et al. | 428/117 |
| 4,557,682 | A | 12/1985 | Montierth | 425/121 |
| 4,557,773 | A | 12/1985 | Bonzo | 156/64 |
| 4,715,801 | A | 12/1987 | Montierth | 425/110 |
| 4,818,317 | A | 4/1989 | Otaka et al. | 156/89 |
| 5,021,204 | A | 6/1991 | Frost et al. | 264/60 |
| 5,219,667 | A * | 6/1993 | Hampton | 428/593 |
| 5,258,150 | A * | 11/1993 | Merkel et al. | 264/43 |
| 6,583,394 | B2 | 6/2003 | Araya et al. | |
| 6,706,233 | B2 | 3/2004 | Araya et al. | 264/432 |
| 6,728,439 | B2 * | 4/2004 | Weisberg et al. | 385/28 |
| RE38,888 | E | 11/2005 | Beall et al. | 501/119 |
| 6,965,099 | B1 * | 11/2005 | Habeger, Jr. et al. | 219/691 |
| 7,087,874 | B2 | 8/2006 | Ishikawa et al. | 219/701 |

(Continued)

FOREIGN PATENT DOCUMENTS

| | | |
|---|---|---|
| EP | 1 491 307 | 12/2004 |

*Primary Examiner*—Khanh Nguyen
*Assistant Examiner*—Keith T Aziz
(74) *Attorney, Agent, or Firm*—Joseph M. Homa

(57) ABSTRACT

Electromagnetic (EM) drying of a plugged ware is provided that includes subjecting the ware to an axially non-uniform EM radiation field that causes more EM radiation to be dissipated in either of the plugged regions than in the unplugged region. The EM radiation field is provided by a configurable applicator system that includes a feed waveguide and a conveyor path. The feed waveguide includes configurable slots. The configurable applicator system can be set to selectively vary the amount of EM radiation dissipated by each ware along the longitudinal axis of each ware as a function of ware position along the conveying path, thereby enhancing the EM drying process.

22 Claims, 12 Drawing Sheets

U.S. PATENT DOCUMENTS

| | | | | |
|---|---|---|---|---|
| 7,550,026 | B2 * | 6/2009 | Hayakawa | 55/523 |
| 2002/0084555 | A1 * | 7/2002 | Araya et al. | 264/430 |
| 2002/0093123 | A1 | 7/2002 | Miura et al. | 264/432 |
| 2002/0186935 | A1 * | 12/2002 | Inui et al. | 385/84 |
| 2003/0051368 | A1 | 3/2003 | Araya | 34/259 |
| 2004/0029707 | A1 | 2/2004 | Beall et al. | 501/119 |
| 2004/0079469 | A1 | 4/2004 | Chan et al. | 156/89.11 |
| 2004/0238535 | A1 | 12/2004 | Mast | 219/730 |
| 2004/0261384 | A1 | 12/2004 | Merkel et al. | 55/523 |
| 2005/0091870 | A1 | 5/2005 | Kato | 34/259 |
| 2006/0042116 | A1 * | 3/2006 | Terazawa et al. | 34/259 |
| 2006/0093784 | A1 * | 5/2006 | Komori et al. | 428/116 |
| 2006/0131782 | A1 | 6/2006 | Mudd et al. | 264/259 |
| 2006/0185335 | A1 | 8/2006 | Ichikawa et al. | 55/523 |
| 2007/0114700 | A1 | 5/2007 | Andrewlavage, Jr. et al. | 264/400 |
| 2007/0231535 | A1 * | 10/2007 | Mizutani | 428/116 |
| 2008/0023886 | A1 * | 1/2008 | Adrian et al. | 264/489 |
| 2008/0174039 | A1 * | 7/2008 | Saijo et al. | 264/43 |

* cited by examiner

METHOD AND APPLICATOR FOR SELECTIVE ELECTROMAGNETIC DRYING OF CERAMIC-FORMING MIXTURE

RELATED APPLICATIONS

This application claims the benefit of U.S. Provisional Application No. 60/921,215, filed Mar. 30, 2007, entitled "Method and Applicator for Selective Electromagnetic Drying of Ceramic Forming Mixture."

FIELD

The present invention relates to articles comprising ceramic-forming mixtures, and more particularly, to selective electromagnetic drying of an article comprising an inorganic ceramic-forming mixture.

BACKGROUND

Honeycomb structures having transverse cross-sectional cellular densities of approximately one tenth to one hundred cells or more per square centimeter have many uses, including as solid particulate filter bodies and stationary heat exchangers. Such uses require selected cells of the structure to be sealed or plugged by manifolding and the like at one or both of the respective ends thereof. The term "sealed" and other corresponding grammatical forms, i.e., sealant, sealing, etc., are used herein to refer to both porous and non-porous methods of closing off the open transverse cross-sectional areas of cells.

For the mass production of such filters and heat exchangers, it is highly desirable to be able to seal selected cell channels ends as rapidly and as inexpensively as possible. Sealing these selected cells comprises inserting a plugging material into the open ends of selected cell channels and subsequently drying the plugged filter. Previous methods for drying have included electromagnetic (EM) drying (e.g., using microwaves), and conventional hot-air drying. The latter includes drying a high porosity ware, such as a green ware, within a drying oven, plugging the open ends of selected cell channels, and re-drying the plugged ware. The process can also be carried out on a fired ware.

This hot-air drying process often results in cracks and stress fractures within the walls of the channels, and filter bodies with a decreased structural integrity. Moreover, these previous techniques are relatively expensive as well as time intensive. Further, existing microwave dryers are generally designed to apply uniform microwave power to the ceramic structure. While this heats the wet plugged ends, it also heats the already-dry or fired regions of the ware. This is inefficient and also tends to overheat the ware, which can lead to structural damage.

SUMMARY

The present invention relates to selective electromagnetic drying of an article that comprises, at least in part, an inorganic ceramic-forming mixture, referred to herein as an "unfinished ceramic ware" or simply "ware". The article comprises a monolith having an axial variation in mass. In some embodiments, the monolith is a honeycomb structure, and the honeycomb structure is comprised of an inorganic ceramic-forming mixture, or is comprised of ceramic, or both, and in some of these embodiments, the honeycomb structure is plugged with an inorganic ceramic-forming mixture. In some embodiments, the honeycomb structure is plugged with an inorganic ceramic-forming mixture and the honeycomb structure is an extruded monolith of an inorganic ceramic-forming batch mixture. In other embodiments, the honeycomb structure is plugged with an inorganic ceramic-forming mixture and the honeycomb structure is a fired ceramic monolith. For example, methods and applicators are disclosed herein that provide for enhanced EM drying of a plugged region of an extruded-type article, such as ceramic honeycomb particulate traps for diesel engines, to reduce the drying cycle time and to avoid damaging the structures.

One aspect of the present invention is a method of drying an unfinished ceramic ware comprising a honeycomb structure having a longitudinal axis and a plurality of cell channels extending axially therethrough, with each cell channel having opposite first and second channel ends. The method includes the steps of inserting a plug material into at least a subset of the first and second channel ends to form a plurality of plugs that respectively constitute first and second plugged ends surrounding an unplugged central region. The method also includes subjecting the plugged ends to more EM radiation than the unplugged central region so that the EM radiation dissipated either of the plugged ends is greater than that dissipated by the unplugged central region.

Another aspect of the invention is a configurable applicator system for EM drying of at least one unfinished ceramic ware comprising a honeycomb structure having a longitudinal axis, plugged regions and an unplugged region. The system includes a drying oven having an interior adapted to accommodate the at least one unfinished ceramic ware. A conveyor passes through the drying oven interior and is adapted to convey the unfinished ceramic ware through the oven interior along a conveying path. In an example embodiment, the conveying path is substantially perpendicular to the longitudinal axis of the conveyed ware(s). The system includes a plurality of configurable EM radiation sources arranged relative to the conveying path. The configurable EM sources can be removed to prevent the emission of EM radiation therefrom. The configurable EM sources can thus be configured to selectively subject the plugged regions to more EM radiation than the unplugged central region so that either of the plugged regions dissipates more EM energy than the unplugged region.

Another aspect of the invention is a method for drying of at least one unfinished ceramic ware comprising a honeycomb structure having a longitudinal axis, plugged ends and a central unplugged region. The method includes providing a drying oven having an interior and a conveying path through the interior. The oven has associated therewith a plurality of configurable EM radiation sources arranged relative to the conveying path. The configurable EM sources are each removable to prevent the emission of EM radiation. The method also includes the step, while conveying each unfinished ceramic ware along the conveying path, selectively subjecting the ware to more EM radiation at the plugged ends than at the central unplugged region so as to cause a greater amount of EM radiation dissipation by either of the plugged ends than by the unplugged region.

Another aspect of the invention is a configurable applicator system for EM drying unfinished ceramic wares each having a longitudinal axis, an end associated with a plugged region and a central unplugged region. The system includes a drying oven having an interior adapted to accommodate at least one unfinished ceramic ware. A conveyor is arranged to pass through the drying oven interior and is adapted to convey the wares along a conveying path through the oven interior. A plurality of configurable EM radiation sources is arranged along and above the conveying path, with each configurable EM radiation source being capable of being removed to prevent the emission of EM radiation. The configurable EM radiation sources allows for selectively varying the amount of EM radiation dissipated by each ware along the longitudinal axis of each ware as a function of conveying path position.

These and other advantages of the invention will be further understood and appreciated by those skilled in the art by reference to the following written specification, claims and appended drawings.

DETAILED DESCRIPTION

Figure 1:
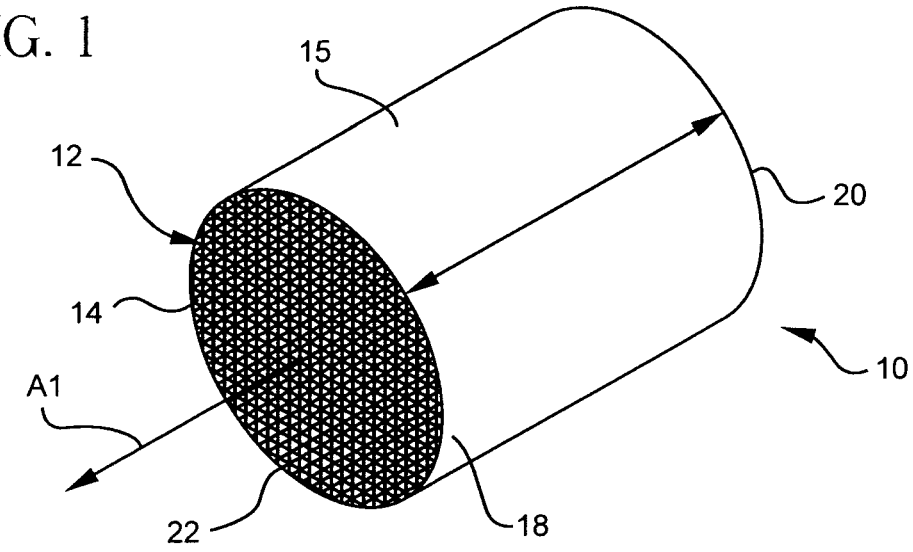
FIG. 1 is a perspective view of an extruded honeycomb structure suitable for use as a filter body, the honeycomb structure including a first end having a plurality of open-ended cell channels.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

FIG. 1 illustrates a ware 10 in the form of a solid particulate filter body ("filter") that may be fabricated utilizing a honeycomb structure 12 having a longitudinal axis A1 that defines the axial direction, and an axial length L. Honeycomb structure 12 is comprised of a matrix of intersecting, thin, porous walls 14 surrounded by an outer wall 15, which in the illustrated example is provided a circular cross-sectional configuration. Honeycomb structure 12 is thus referred to also as the "matrix." The walls 14 extend across and between a first end face 18 and an opposing second end face 20, and form a large number of adjoining hollow passages or cell channels 22 that also extend between, and are open at, the end faces 18, 20 of the ware 10. Each cell channel 22 thus has a first channel end 23A at end face 18 and a second channel end 23B at end face 20.

Figure 2:
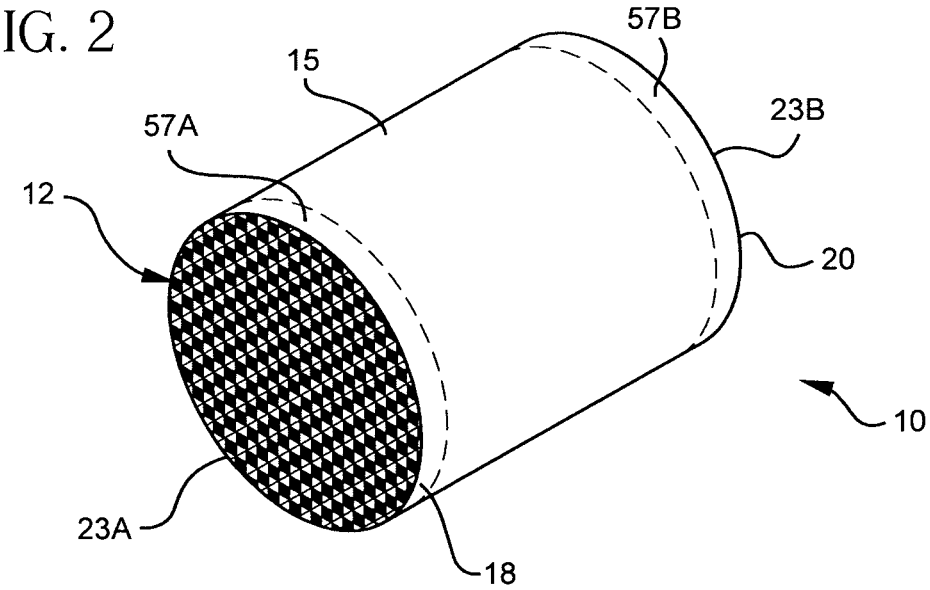
FIG. 2 is a perspective view of the honeycomb structure, wherein a first subset of the cell channels are plugged, and a second subset of the cell channels are open-ended.
Figure 3:
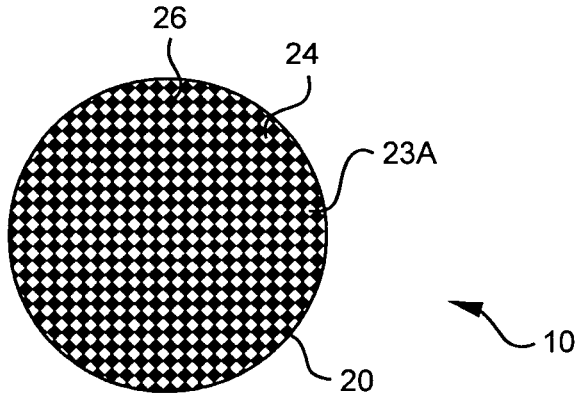
FIG. 3 is a side view of the honeycomb structure including a second end, wherein the first subset of the cell channels are open-ended and a second subset of the cell channels are plugged.

To form some embodiments of ware 10 (FIGS. 2 and 3), one channel end 23A or 23B of each cell channel 22 is sealed, with a first subset 24 of the channel cells 22 being sealed at the channel ends 23A of first end face 20, and a second subset 26 of the channel cells 22 being sealed at channel ends 23B of the second end face 18 of the ware 10. In some embodiments, either of the end faces 18, 20 may be used as the inlet face of the resulting filter. The material used to seal ("plug") channels ends 23A and 24A preferably comprises a ceramic-forming paste, such as made up of inorganic powder, water and organics. In some embodiments, the plug material in a ware may constitute about 5% by volume of the overall structure. Honeycomb structure 12 and the plug material are dried and fired to result in a filter.

In the operation of a filter, contaminated fluid (liquid or gas) is brought under pressure to an inlet face and enters the filter via those cells which have an open end at the inlet face. Because these cells are sealed at the opposite end face, i.e., the outlet face of the body, the contaminated fluid is forced through the thin porous walls 14 into adjoining cells which are sealed at the inlet face and open at the outlet face. The solid particulate contaminant in the fluid, which is too large to pass through the porous openings in the walls, is left behind and a cleansed fluid exits the filter through the outlet cells and is ready for use.

Forming the Ware

Figure 4:
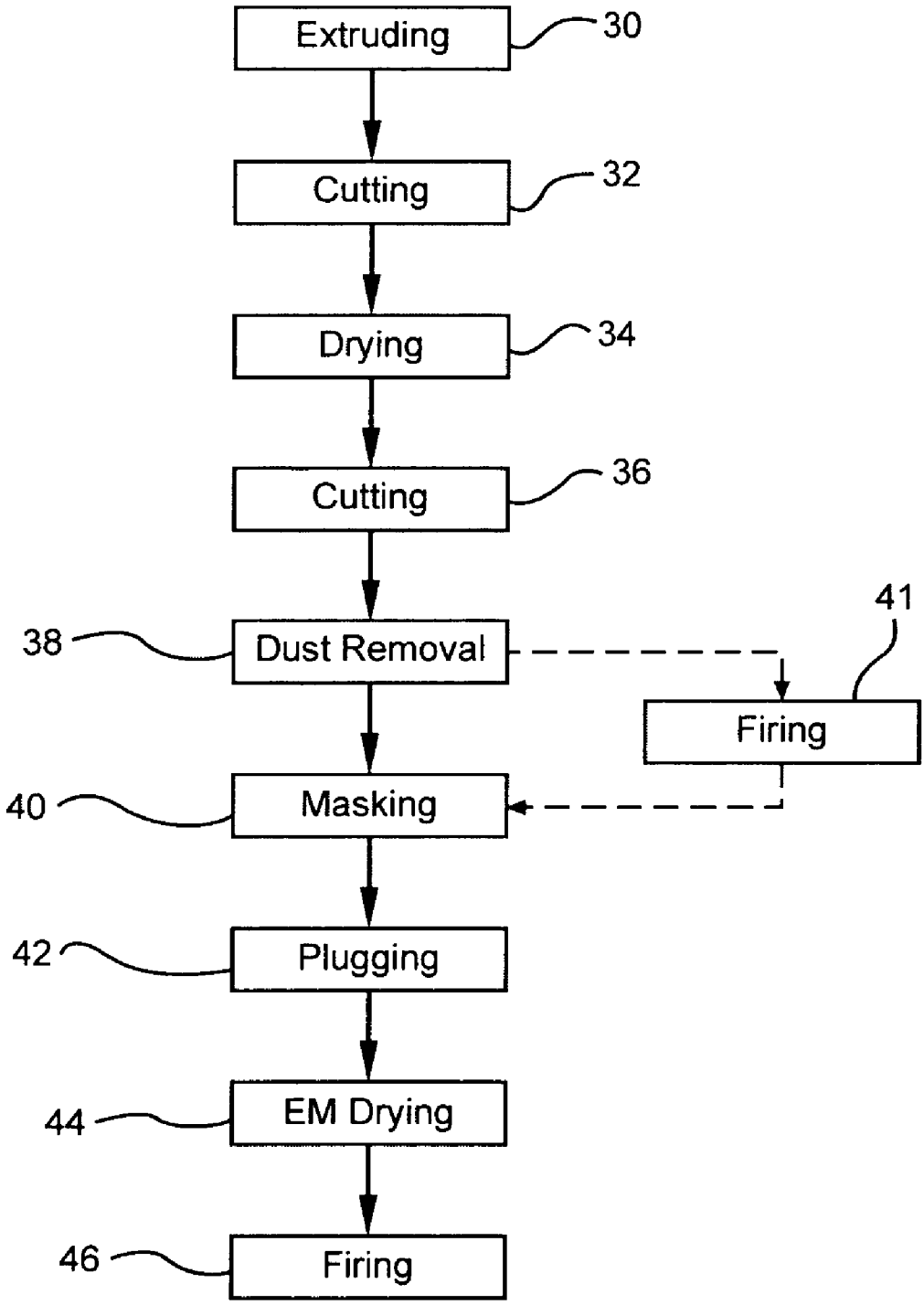
FIG. 4 is a flow chart for either a single-fire or dual-fire process for forming an unfinished ceramic ware comprised of the plugged honeycomb structure to be dried using the systems and methods of the present invention.

In some embodiments, the present inventive drying process can be incorporated within an overall process that comprises extruding (step 30, FIG. 4) a wet, preferably aqueous-based ceramic-forming precursor mixture through an extrusion die to form a wet log, cutting (step 32, FIG. 4) the wet log formed during the extrusion step into a plurality of segmented portions, and drying (step 34, FIG. 4) the segmented portions so as to form a green honeycomb form (a green honeycomb log). The aqueous-based ceramic precursor mixture preferably comprises a batch mixture of ceramic (such as cordierite or aluminum titanate) forming inorganic precursor materials, an optional pore former such as graphite or starch, a binder, a lubricant, and a vehicle. The inorganic batch components can be any combination of inorganic components which can, upon firing, provide a porous ceramic having primary sintered phase composition (such as a primary sintered phase composition of cordierite or aluminum titanate).

In an example embodiment, the inorganic batch components can be selected from a magnesium oxide source; an alumina-forming source; and a silica source. The batch components are further selected so as to yield a ceramic article comprising predominantly cordierite, or a mixture of cordierite, mullite and/or spinel upon firing. For example, and without limitation, in one aspect, the inorganic batch components can be selected to provide a ceramic article which comprises at least about 90% by weight cordierite; or more preferably 93% by weight the cordierite. In an example embodiment, the cordierite-containing honeycomb article consists essentially of, as characterized in an oxide weight percent basis, from about 49 to about 53 percent by weight $SiO_2$, from about 33 to about 38 percent by weight $Al_2O_3$, and from about 12 to about 16 percent by weight MgO. To this end, an exemplary inorganic cordierite precursor powder batch composition preferably comprises about 33 to about 41 weight percent of an aluminum oxide source, about 46 to about 53 weight percent of a silica source, and about 11 to about 17 weight percent of a magnesium oxide source. Exemplary non-limiting inorganic batch component mixtures suitable for forming cordierite are disclosed in U.S. Pat. Nos. 3,885,977; 5,258,150; US Pub. No. 2004/0261384 and 2004/0029707; and RE 38,888.

The inorganic ceramic batch components can be synthetically produced materials such as oxides, hydroxides, and the like. Alternatively, they can be naturally occurring minerals such as clays, talcs, or any combination thereof. Thus, it should be understood that the present invention is not limited to any particular types of powders or raw materials, as such can be selected depending on the properties desired in the final ceramic body.

The process further comprises cutting or segmenting (step 36, FIG. 4) the green honeycomb log into green honeycomb structures of a desired length, and thereafter removing dust 38 from the green honeycomb structures as formed during the cutting step 36, i.e., the green ceramic precursor cutting dust. The dust is removed to improve the adherence of the plug material to the wall and to improve the adherence of the mask to the end of the honeycomb structure. The dust removal step is preferably accomplished by passing high velocity air through the cell passages 22 of the honeycomb structure after the cutting step to dislodge and remove any cutting dust. At this point, honeycomb structure 12 can be fired (step 41 for a dual-firing process) and then plugged as described below. In a single-firing process, honeycomb structure 12 does not undergo firing step 41 after masking step 40.

Plugging and Drying the Channel Ends

In some embodiments, each end face 18, 20 of each honeycomb structure 12 is then masked 40 with a suitable mask, and selected cell passages 22 are charged with a plugging material at channel ends 23A or 23B to form plugs 42 in selected ones of the cell channels to form a plugged, green honeycomb structure, as described below. This unfinished ceramic ware (here, a plugged, green (or fired) honeycomb structure) is then dried (step 44, FIG. 4) by exposing the plugged, green (or fired) honeycomb structure to an EM energy field that subjects the honeycomb structure to more EM radiation to the plugged regions than to the unplugged region (and hence more EM radiation to the plugged ends than to the unplugged central region) in accordance with the present invention as described in greater detail below. The dried, plugged honeycomb structure may then be fired (step 46, FIG. 4) for further sintering and to form the fired ceramic article. Several steps of this overall process are known to those skilled in the art, and as such the steps of extruding 30, the primary cutting step 32, the step of drying 34, the secondary cutting step 36, and the masking step 40 are not discussed in detail herein.

Figure 5A:
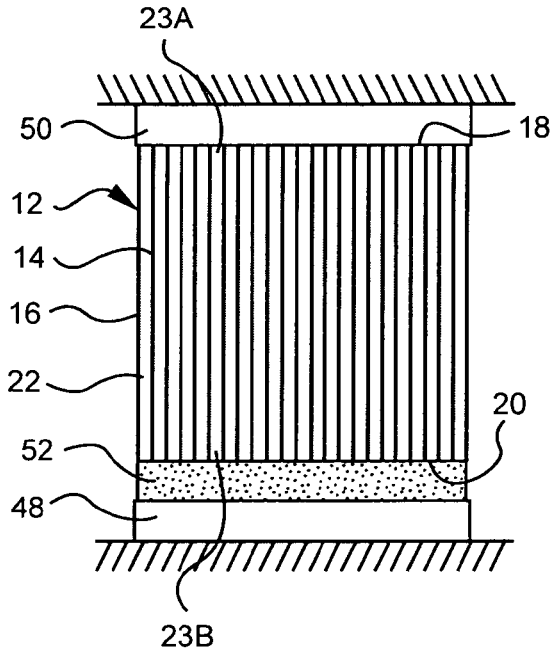
FIG. 5A is a cross-sectional side view of a green honeycomb structure, a top platen and a bottom platen, with the top platen located in a starting position.
Figure 5B:
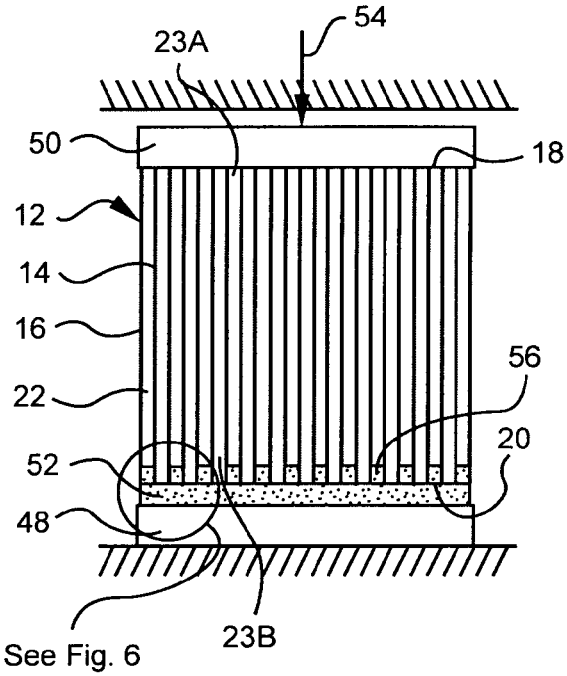
FIG. 5B is a cross-sectional side view of the green honeycomb structure and the top and bottom platens with a plugging material inserted into the second subset of the cell channels.
Figure 6:
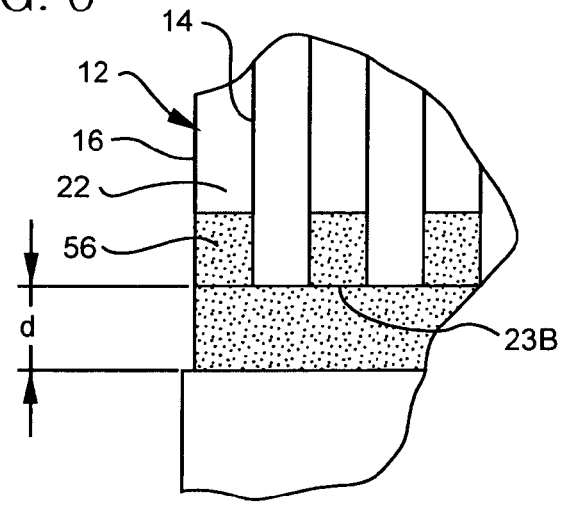
FIG. 6 is an enlarged cross-sectional side view of the area IV of FIG. 5B.

The step of plugging honeycomb structure 12 includes charging or otherwise introducing a flowable plugging cement material, such as a slurry preferably comprising a water diluted ceramic-forming solution, into selected cell channels 22 as determined by the plugging mask. Plugging masks may be formed by the method taught in U.S. patent application Ser. No. 11/287,000 filed Nov. 20, 2005, for example, entitled "Apparatus, System and Method For Manufacturing A Plugging Mask For A Honeycomb Substrate" which application is hereby incorporated by reference herein. An example of the plugging process (step 42, FIG. 4) is illustrated in FIGS. 5A and 5B, and utilizes a fixed bottom platen 48 and a movable top platen or piston 50. The present configuration of the platens 48, 50 are for illustrative purposes only, and it is noted that other methods for charging or plugging the cell channels 22 may be utilized, including utilizing a fixed top platen and a movable bottom platen, or moveable top and bottom platens. In the illustrated example, the plugging material is provided in the form of a cement patty 52 generally having a shape of the end face 20 of the structure 12. The patty 52 is positioned between the bottom platen 48 and the second end face 20 of the green honeycomb structure 12. The top platen or piston 50 is then moved in a direction as indicated in FIG. 5B and represented by directional arrow 54 so as to force at least a portion of the plugging material or cement patty 52 into the unmasked open ends of the cell channels 22, thereby forming a plurality of plugs 56 within selected cell channels 22.

Plugs 56 are provided so as to have a depth "d", which in example embodiments can be between 0.5 mm to 20 mm, more preferably to have a depth "d" of between 0.5 mm and 12 mm, and most preferably to have a depth "d" of between 0.5 mm and 9 mm, so as to provide proper plugging of the cell channels 22 and proper drying of the plugs 56 during the EM drying step 44. The two end-portions of honeycomb structure 12 occupied by plugs 56 at end faces 18 and 20 are referred to herein as plugged ends 57A and 57B, which surround a central unplugged region 58.

After the charging-insertion step of cement 52 to form plugs 56 is complete, the mask is preferably removed from ends 18 and 20 of the structure 12. Although plugging by using a patty is described herein, the plugging step may be accomplished by any known plugging method, such as taught in U.S. Pat. No. 4,818,317; PCT/US05/042672 filed Nov. 5, 2005; U.S. Pat. No. 4,427,728; U.S. Pat. No. 4,557,682; U.S. Pat. No. 4,557,773; U.S. Pat. No. 4,715,801; and U.S. Pat. No. 5,021,204 for example. Suitable plugging materials may be of the same or similar composition as the green honeycomb structure, or optionally as described in U.S. Pat. No. 4,329,162 to Pitcher and U.S. Pat. No. 4,297,140 to Paisley.

In an example embodiment of the present invention, honeycomb structure 12 comprises either a low-loss matrix and high-loss plug material or a high-loss matrix and a high-loss plug material. High-loss materials include, for example, graphite, $TiO_2$, SiC and/or water. The low-loss portions include, for example, relatively little or none of $TiO_2$, SiC and/or water. In an example embodiment, the high-loss matrix is a dried green honeycomb structure and the high-loss plug material is wet. In another example embodiment, the low-loss matrix is a fired ware and the high-loss plug material is wet. In an example embodiment, "high loss" is $\in''>0.02$, while "low loss" is $\in''\leqq 0.02$, wherein $\in''$ is the dielectric loss of the material. Three exemplary ($1^{st}$, $2^{nd}$, and $3^{rd}$) combinations of matrix and plug materials were analyzed. Type 1 and Type 2 matrix materials were both high loss, and Type 3 matrix material was low loss. Both Type A and Type B plug materials were high loss. The first combination was Type 1-Type A, the second combination was Type 2-Type B, and the third combination was Type 3-Type A.

Enhanced EM Drying of the Plugged Ends

The present invention includes an enhanced plug drying process wherein the wet plugs 56 at the plugged ends 57A and 57B are heated to drive off water therein while other parts of ware 10 that are relatively dry (namely, central unplugged region 58) are not substantially heated, i.e., are heated only to the extent that water is not allowed to condense therein or thereon and also preferably not heated so much as to cause cracking or other undesirable effects. Further, because the contact of the wet plugs 56 with the dry matrix can result in a water gradient into the matrix, in an example embodiment of the invention, absorbed water is removed from the matrix as well.

Accordingly, the EM drying step 44 of the present invention includes subjecting honeycomb structure 12 to more EM energy at plugged ends 57A and 57B as compared to central unplugged region 58. In an example embodiment, this is accomplished by subjecting ware 10 to an axially non-uniform EM energy distribution that is greater at plugged ends 57A and 57B than at central unplugged region 58 so that the amount EM energy dissipated by the plugged ends is substantially greater than the amount of EM energy dissipated by the unplugged region. In an example embodiment, the EM energy is provided in the form of microwave radiation. However, other suitable forms of EM energy may also be utilized, such as infra-red radiation or radio-frequency (RF) radiation.

Figure 7:
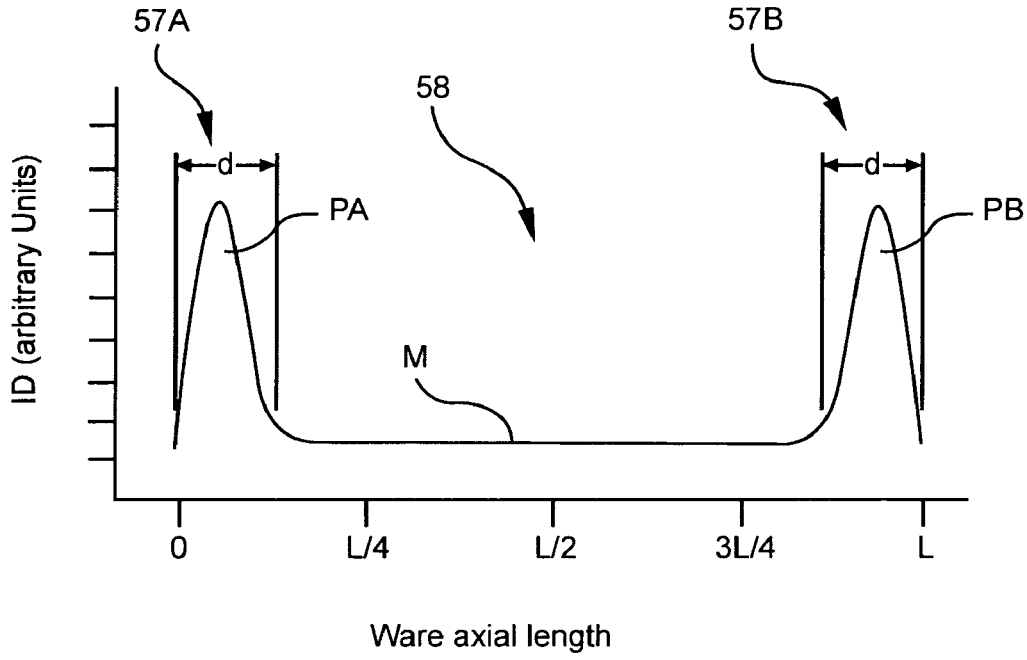
FIG. 7 is a plot of the integrated EM power dissipation (ID) vs. the ware axial length, illustrating the nature of the non-uniform ID according to the present invention wherein more EM energy is dissipated by the plugged ends than by the unplugged central region.
Figure 8:
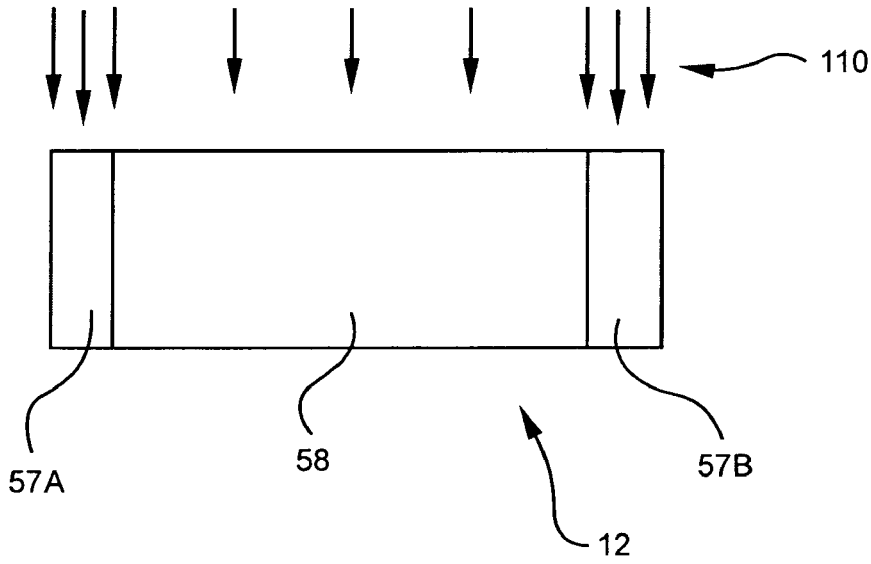
FIG. 8 is a schematic diagram illustrating an example embodiment of the effect of the present invention wherein the plugged ends are exposed to a greater amount of EM radiation than the central unplugged region.

FIG. 7 is a plot of an idealized integrated EM power dissipation ("integrated dissipation ID") (arbitrary units) vs. the axial length of the ware (in units of L) according to the present invention. Plugged ends 57A and 57B of honeycomb structure 12 are schematically represented as dashed lines for the sake of reference. The ID plot includes two peaks PA and PB that correspond to plug end-portions 57A and 57B of honeycomb structure 12, and a middle region M have a lower ID value than the peaks. Peaks PA and PB represent the relative average power delivered to ware 10 at plugged ends 57A and 57B, while M represents the average power dissipation in unplugged region 58. An axially non-uniform EM radiation field that provides a greater exposure to end-portions 57A and 57B than to other parts of the structure has been found by the present inventors to be more efficient for drying plugs 56 in the plugged ends 57A and 57B. FIG. 8 is a schematic diagram illustrating an example embodiment of the effect of the present invention wherein the plugged ends 57A and 57B are exposed to a greater amount of EM radiation than the central unplugged region using an axially non-uniform EM radiation field 110, which creates the EPD shown in the plot of FIG. 7.

As discussed in detail below, in certain cases in involving applicators used to dry a number of wares at once, the EM radiation field 110 is often a relatively complex function of the applicator geometry, EM frequency used, and related parameters. Accordingly, applicator systems and methods are discussed below that create a relatively complex EM field 110, represented schematically in FIG. 8 as an axially non-uniform field, for performing enhanced EM drying of wares 10 according to the present invention.

The EM drying of the plugs 56 in ware 10 using an axially non-uniform EM exposure results in a relatively quick and uniform heating of the green honeycomb structure and the plugs 56. This reduces plug shrinkage and decreases the heat stress exerted on the porous walls 14 of the green honeycomb structure 12 during the drying step 44 as compared to conventional drying approaches. This reduction in stress exerted on the porous walls 14 results in a greater structural integrity of the resultant fired article. The plugs 56 are preferably exposed to the microwave energy until the water content of the plugs 56 are less than 50% of a 100% wet plug weight, more preferably less than 10% of the 100% wet plug weight, and most preferably less than about 5% of the 100% plug weight, with the 100% wet plug weight being defined as the water content of the plug 56 prior to being exposed to the microwave energy.

Preferably, the EM radiation is provided in the form of microwave energy, and preferably within the range of from about 3 MHz to about 3 GHz, more preferably within the range of from about 27 MHz to about 2.45 GHz, and most preferably within the range of from about 915 MHz to about 2.45 GHz. Further, the EM drying step 44 includes exposing the plugged green honeycomb structure to a power level per unit volume of preferably between 0.0001 $kW/in^3$ and 1.0 $kW/in^3$, and more preferably within the range of between 0.001 $kW/in^3$ and about 1.0 $kW/in^3$. Moreover, the energies as noted above are preferably applied to the plugged green honeycomb structure for a time of less than or equal to 60 minutes, and more preferably for a time of less than or equal to 5 minutes. EM drying, such as microwave drying, is discussed in U.S. Pat. No. 6,706,233 and US 2004/0079469, which patent and patent application publication are incorporated by reference herein.

Example Applicator System

An aspect of the present invention is directed to a configurable applicator system with which a non-uniform EM radiation exposure is used along the axis of ware 10 (plugged honeycomb structure 12) for drying the plugged ends 57A and 57B while not overheating the unplugged central region 58. The method is identified and described generally by the ratio of the EM power dissipation in the plugged ends to the equivalent EM power dissipation in the dry matrix region. The applicator system is configurable to control the ware heating rates (the EM power dissipation) as the ware moves through the applicator system.

In the present invention, "configurable" does not necessarily imply that changes to an existing configuration can be made as ware travels along the conveying path. As one skilled in the art will understand and appreciate, making configuration changes to present-day applicators can be a time-consuming process that involves design, build, and install steps that can take days or even weeks. Such time-consuming process can be avoided by the present invention, thereby providing industrial value, for example by eliminating the guesswork out of configuring an applicator for efficient drying of wares.

An example embodiment of the present invention is a configurable applicator system adapted to perform the enhanced EM drying of the plugged ends as described above. As described in detail below, an aspect of the invention is a method of configuring the configurable applicator to perform efficient (if not optimal) EM drying of wares 10 by establishing the appropriate EM conditions inside the applicator. Configurable applicator system 200 is configurable so that the drying properties of the system can be made to selectively vary along the conveyor path as the ware 10 travels through the system.

Figure 9:
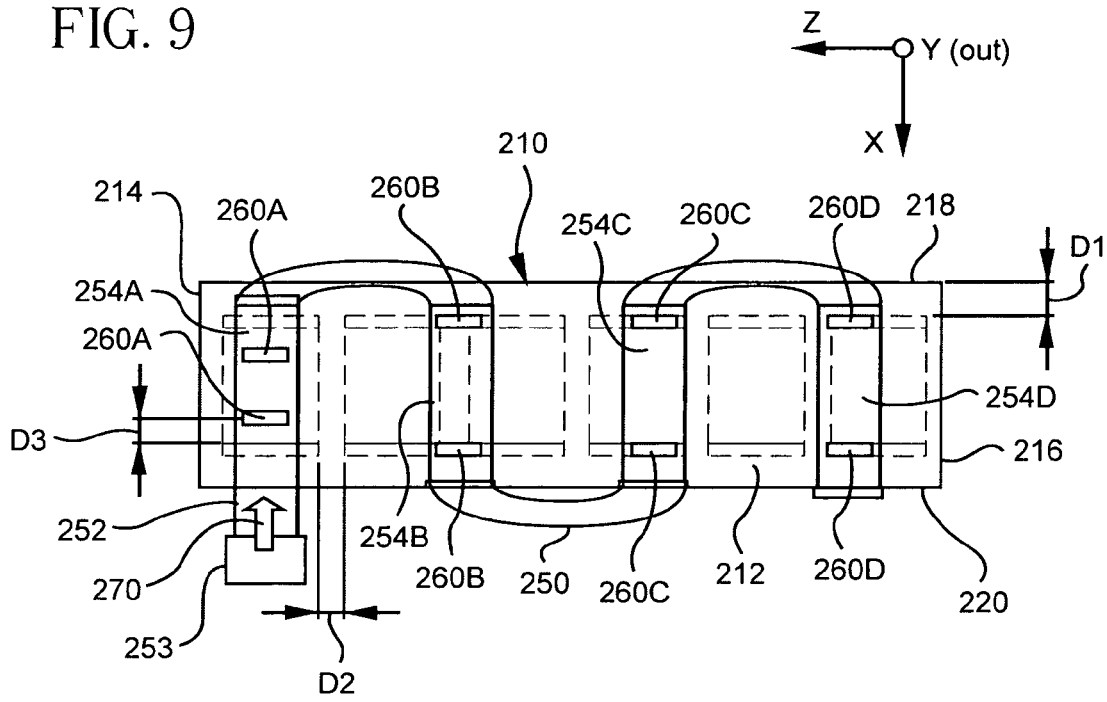
FIG. 9 is schematic plan view of an example embodiment of a configurable applicator according to the present invention.
Figure 10:
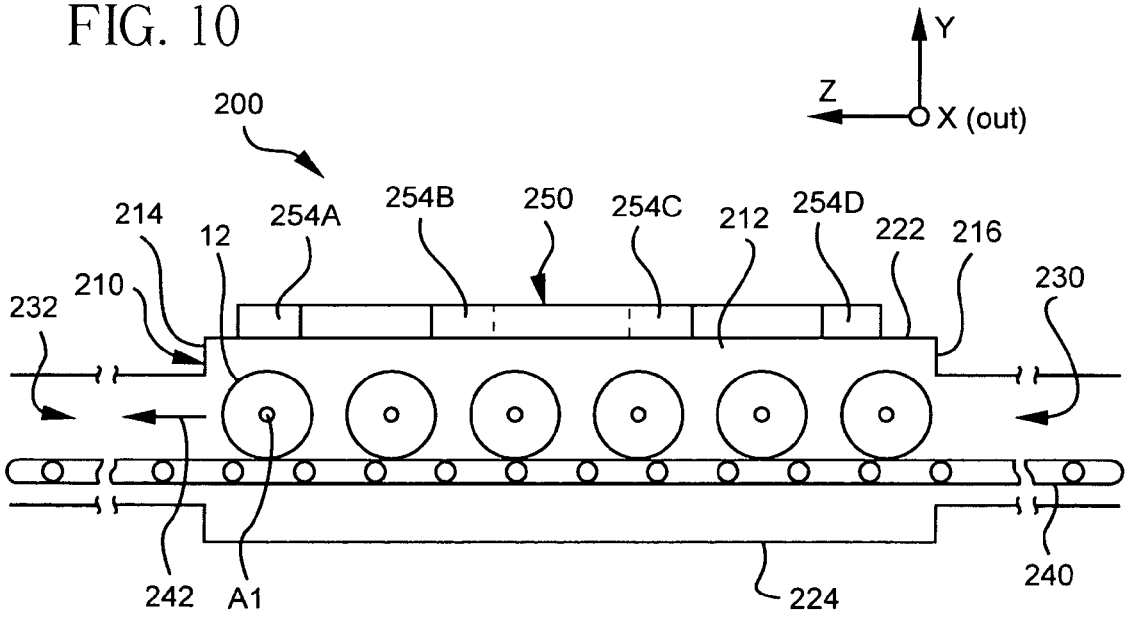
FIG. 10 is a side view of the applicator of FIG. 9, showing the wares being conveyed through the interior of the drying oven.
Figure 11:
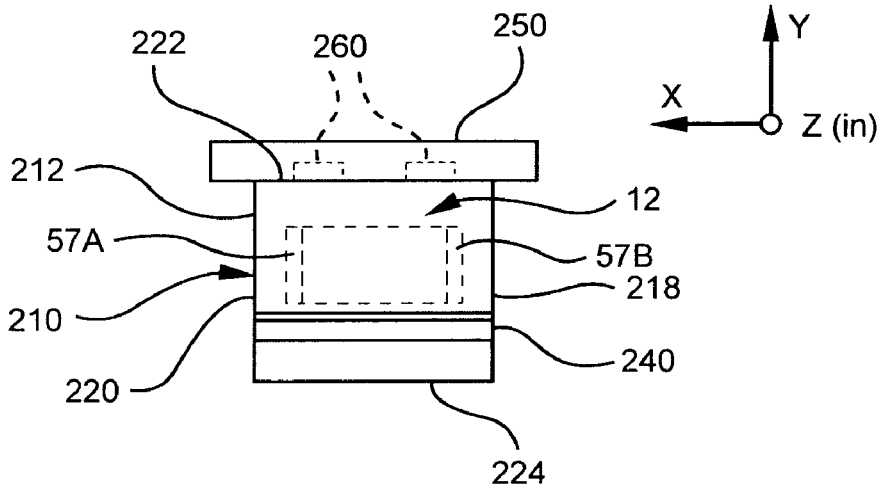
FIG. 11 is an end-on view of the applicator of FIG. 9.

FIG. 9 is a schematic plan diagram of an example embodiment of a configurable applicator system 200 according to the present invention. FIG. 10 is a schematic side view of the configurable applicator system of FIG. 9, while FIG. 11 is an end-on view of the configurable applicator system. Each of FIGS. 9, 10 and 11 includes Cartesian coordinates for the sake of reference.

With reference to FIGS. 9 through 11, applicator system 200 includes a drying oven 210 having an interior region 212 defined by opposing sidewalls 214, 216, opposing sidewalls 218 and 220, an opposing upper (ceiling) and lower (floor) walls 222 and 224. Drying oven 210 also includes an entrance opening ("entrance") 230 formed in sidewall 214 and an exit opening ("exit") 232 formed in sidewall 216 that each open to oven interior 212. Interior region 212 accommodates a number of wares 12 that need to be dried as discussed above.

Applicator system also includes a conveyor 240 for conveying honeycomb structures 12 along a conveyor path (direction) 242 into oven interior 212 through entrance 230, through the oven interior, and out of exit 232 during the drying process. Conveyor direction 242 is shown as being in the Z-direction for the sake of illustration. Honeycomb structures 12 have their central axis A1 arranged in the X-direction, which is perpendicular to conveyor direction 242 when the honeycomb structures are conveyed through oven interior 212.

Applicator system 200 also includes a serpentine feed waveguide 250 arranged in oven interior 212 adjacent ceiling 222 so that it lies in the X-Z plane. Feed waveguide 250 includes an input end 252 operably coupled to an EM radiation source 253, such as a microwave radiation source. Feed waveguide 250 includes a number of sections 254 (e.g., the four sections labeled as 254A, 254B, 254C and 254D) that lie perpendicular to conveyor direction 242 (although in other embodiments, the sections 254 could lie parallel to the conveyor direction 242). Waveguide sections 254 each include one or more slots 260 (labeled as 260A, 260B, 260C, and 260D to corresponding to the associated waveguide sections). Slots 260 are configurable in the X-direction, i.e., in the direction parallel to conveyor direction 242, as illustrated in the close-up schematic diagram of FIG. 12 (although in other embodiments, the slots 260 could lie perpendicular to the conveyor direction 242 preferably so long as slots 260 are perpendicular to the longitudinal axis of the ware). Slots 260 serve as configurable sources of EM radiation 270 of wavelength $\lambda$ for EM radiation inputted into feed waveguide 250 at input end 252 by EM radiation source 253. One or more of slots 260 can also be removed to prevent EM radiation from radiating from the removed slots into oven interior 212.

A shorthand notation for describing the number of (open) slots in a given configuration having four waveguide sections 254 (i.e., 254A, 254B, 254C and 254D) is "$n_A$-$n_B$-$n_C$-$n_D$," wherein $n_A$, $n_B$, $n_C$ and $n_D$ respectively represent the number of open slots for the corresponding waveguide segment. Thus, for configurable applicator system 200 of FIG. 9 through FIG. 11 having all open slots, the slot geometry is described as "2-2-2-2." Again, each waveguide segment can have one or more configurable slots. Two slots per segment are shown for the sake of illustration.

Figure 12:
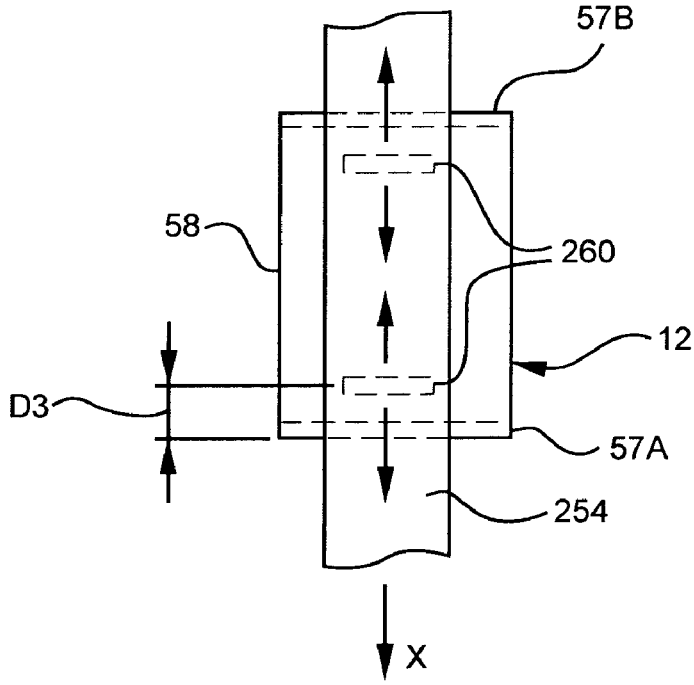
FIG. 12 is a close-up schematic diagram of a waveguide section of the feed waveguide, showing the configurable slots relative to an underlying ware that resides within the oven interior.

A number of geometric parameters relating to wares 10 and drying oven 210 are used in the present invention as described below. A first geometric parameter D1 is the spacing between sidewalls 218 and 220 and respective honeycomb structure end-faces 18 and 20. A second parameter D2 is the spacing between adjacent wares. A third parameter D3 is the spacing in the X-direction of slots 260 relative to respective ware end faces 18 and 20. Slot spacing D3 can be adjusted in the X-direction when configuring the slots, as illustrated in FIG. 12. Another geometric parameter is "head space" D4, which is the distance between honeycomb structure 12 and ceiling 222. Another input parameter is the EM radiation polarization P, which can be either TM or TE.

Applicator System Configuration for Efficient EM Drying

Changing the configuration of configurable applicator system 200, particularly by adjusting the number and positions of slots 260 relative to conveyor path 242, results in different EM power dissipations in ware 10 and thus different ware drying capabilities for the system. The particular applicator system configuration that is most effective in drying wares 10 depends on the particular type of wares 10 to be processed, as well as the applicator system design and number of adjustable parameters (i.e., the system degrees of freedom).

In this regard, the inventors have discovered that small changes in certain aspects of an applicator system's configuration can have profound changes in the efficiency of the plug drying process. Moreover, rather than resorting to time-consuming, ware-consuming, and often inaccurate empirical methods to determine an applicator configuration efficient for ware drying, the present invention employs a more sophisticated approach of configuring a configurable applicator based on EM simulations and computer modeling that utilize certain key input parameters to generate a Figure of Merit $F_M$ that relates to the efficiency of the ware drying process based on one or more types of wares. Calculating a number N of sets $S_1\{F_M\}$, $S_2\{F_M\}$, $S_3\{F_M\}$ . . . $S_N\{F_M\}$ of Figures of Merit $F_M$ based on the various possible configurations allows one to establish an efficient applicator configuration for the particular type, or types, of ware or wares to be processed.

This optimization-based approach of the present invention is of particular value in the case where more than one ware type (e.g., plug-matrix material combination) is to be processed by configurable applicator system 200. An aspect of the invention as described below is to "tune" the configurable applicator system 200 so that its drying properties selectively vary along the conveyor path from the entrance end to the exit end. This takes advantage of the fact that the ware may be more amenable to strong irradiation of its plugged ends 57A and 57B when these ends are wet (at or near entrance 230) than when they become more dry (at or near exit 232).

Figure 13:
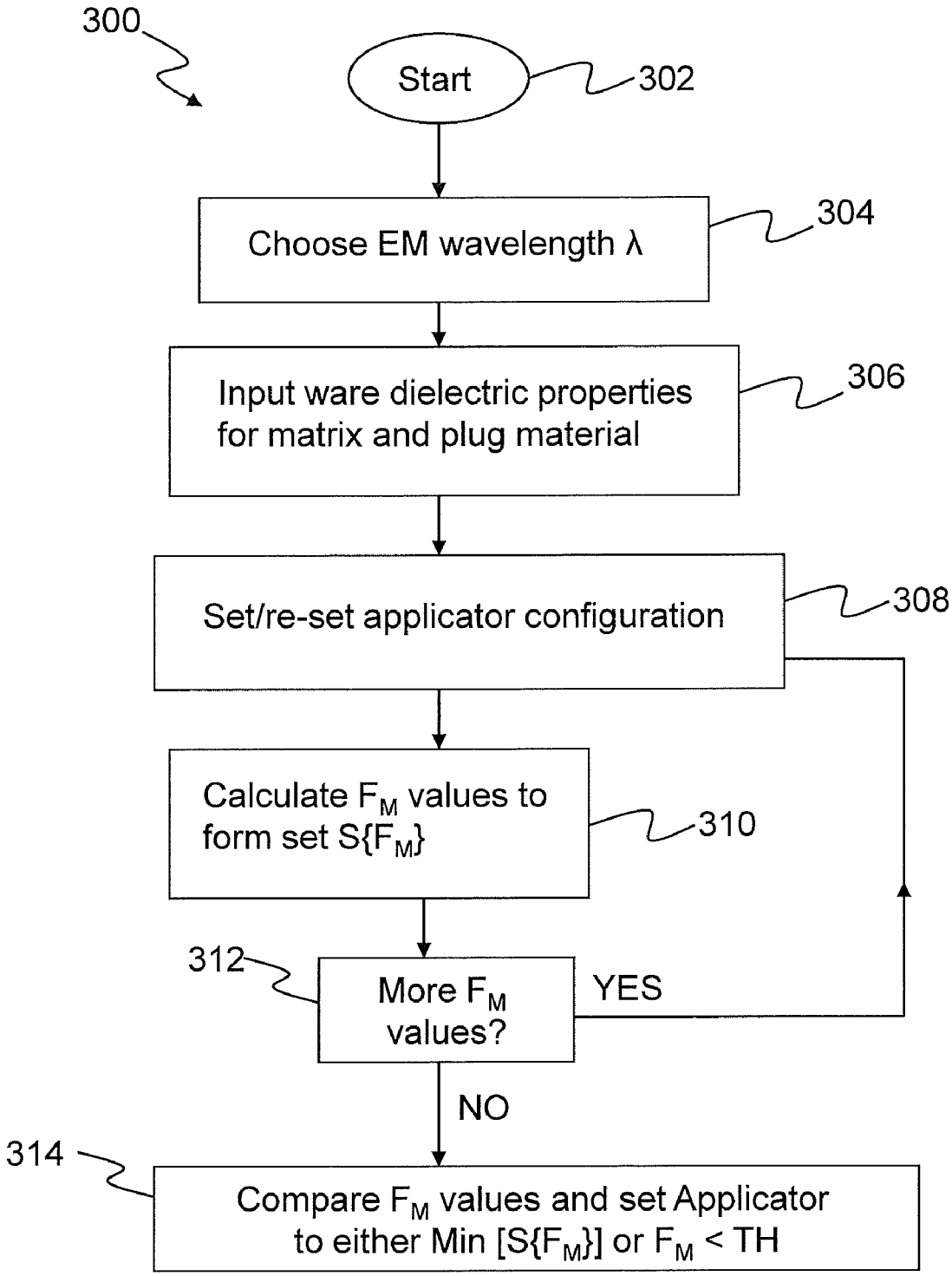
FIG. 13 is a flow diagram of an example embodiment of a method of setting the configuration of the configurable applicator system based on a Figure of Merit calculation to achieve efficient drying of the wares processed therein.

FIG. 13 is a first flow diagram 300 that outlines the general computer-modeling-based method of selecting a configuration for configurable applicator system 200 that is best suited for drying wares having a single plug-matrix material combination. Flow diagram 300 begins at start step 302 and proceeds to step 304, which involves selecting a wavelength λ for EM radiation 270, such as wavelength corresponding to one of the aforementioned EM frequencies. Step 306 then involves identifying the materials that make up ware 10 and inputting the ware dielectric properties. This includes inputting the dielectric properties (i.e., the dielectric constant and dielectric loss) of both the matrix as well as plugs 56 of plugged ends 57A and 57B. By way of example, the dielectric constant of the matrix material can be 1.2 to about 70, which value depends on whether the material fired or green. The dielectric loss of the matrix material can be 0.001 to about 40. By way of example, the dielectric constant of the plug material can be 8 to about 100. The dielectric loss of the plug material can be about 7 to about 40. It is assumed that applicator system 200 will eventually need to process a number N>1 different types of wares 12 (e.g., wares formed from different plug-matrix material combinations). Flow diagram 300 is for processing a single plug-material combination. The method of processing a number N>1 of different plug-matrix material combinations is set forth in detail below.

In the next step 308, an initial configuration for configurable applicator system 200 is set. In subsequent passes through the flow diagram, the application configuration is re-set. This includes setting the values for the dryer configuration parameters discussed above. In an example embodiment, D1 is about λ/4, D2<3λ4, D3<+/−λ, and D4 is about λ/4. Polarization was TM at 915 MHz. It should be noted that the setting and re-setting of the slot configurations in the computer-based optimization approach of the present invention takes just seconds, while physically setting and re-setting a slot configuration to empirically perform optimization experiments can take a matter of weeks.

It should be mentioned that certain slot configurations provide for somewhat predictable ware heating. For example, the slot configuration 0-0-0-$n_D$ design generally provides for rapid initial heating which then tapers off as the ware moves toward exit 232. On the other hand, the slot configuration $n_A$-0-0-0 generally provides a slow heating rate, with the most of the power incident on the ware as the ware exits the drying oven at exit 232. Generally speaking, however, it is not immediately apparent which applicator configuration provides the most effective drying of ware for different types of ware materials and for the relatively complex three-dimensional ("3D") EM radiation field distribution that exists within oven interior 212 as the wares move therethrough. The present invention therefore seeks to associate a select applicator configuration (and in particular a slot configuration) to a select EM radiation field pattern formed within the oven interior associated with efficient ware drying.

For plug drying of honeycomb structures 12, the matrix material that makes up unplugged central region 58 will often have very low loss. This means that slots arranged immediately above unplugged central region 58 of such a honeycomb structure will tend to see the metallic opposing walls of oven 210, which cause a great deal of reflected EM power. Accordingly, in an example embodiment, slots 260 that would directly irradiate this region are either moved (i.e., D3 is adjusted) or blocked off so that this honeycomb structure region is not directly irradiated with EM radiation.

The next step 310 involves calculating a Figure of Merit $F_M$ that generally represents the drying efficiency of the given applicator configuration for a given plug-matrix material combination. The details involved in calculating the Figure of Merit $F_M$ are discussed below in connection with flow diagram 400. Once a Figure of Merit is obtained for a given slot configuration, the method proceeds to query step 312, which asks whether enough Figures of Merit have been calculated to create a set $S_N\{F_M\}$ of Figures of Merit $F_M$. If more Figures of Merit are needed to represent different system configurations (usually six to twelve values of $F_M$ to a set $S\{F_M\}$ is sufficient), then the method returns to step 308 wherein the applicator configuration is re-set. This may involve, for example, adjusting one of the application configuration parameters, such as the slot configuration.

Generally speaking, at first it is preferred to fix the wavelength and the polarization. Preferably, the geometric parameters of the dryer are determined second, so that finally the slots (number and placement) are determined.

Once a suitable number of Figures of Merit $F_M$ are obtained to form a sufficiently large set $S\{F_M\}$, then in step 314 the values of $F_M$ for the given set $S\{F_M\}$ are compared. Generally, the smallest value of $F_M$ in the set corresponds to the most favorable applicator system geometry for drying the ware. However, values of $F_M$ below a select threshold TH can be identified that correspond to suitable applicator system configurations. In an example embodiment, TH=0.5.

Once a minimum $F_M$ is established, then configurable applicator system 200 is set up to have the configuration corresponding to either the minimum $F_M$ ("Min [$S\{F_M\}$]") or alternatively, to one of the configurations having a corresponding value of $F_M$ below threshold TH.

Figure 14:
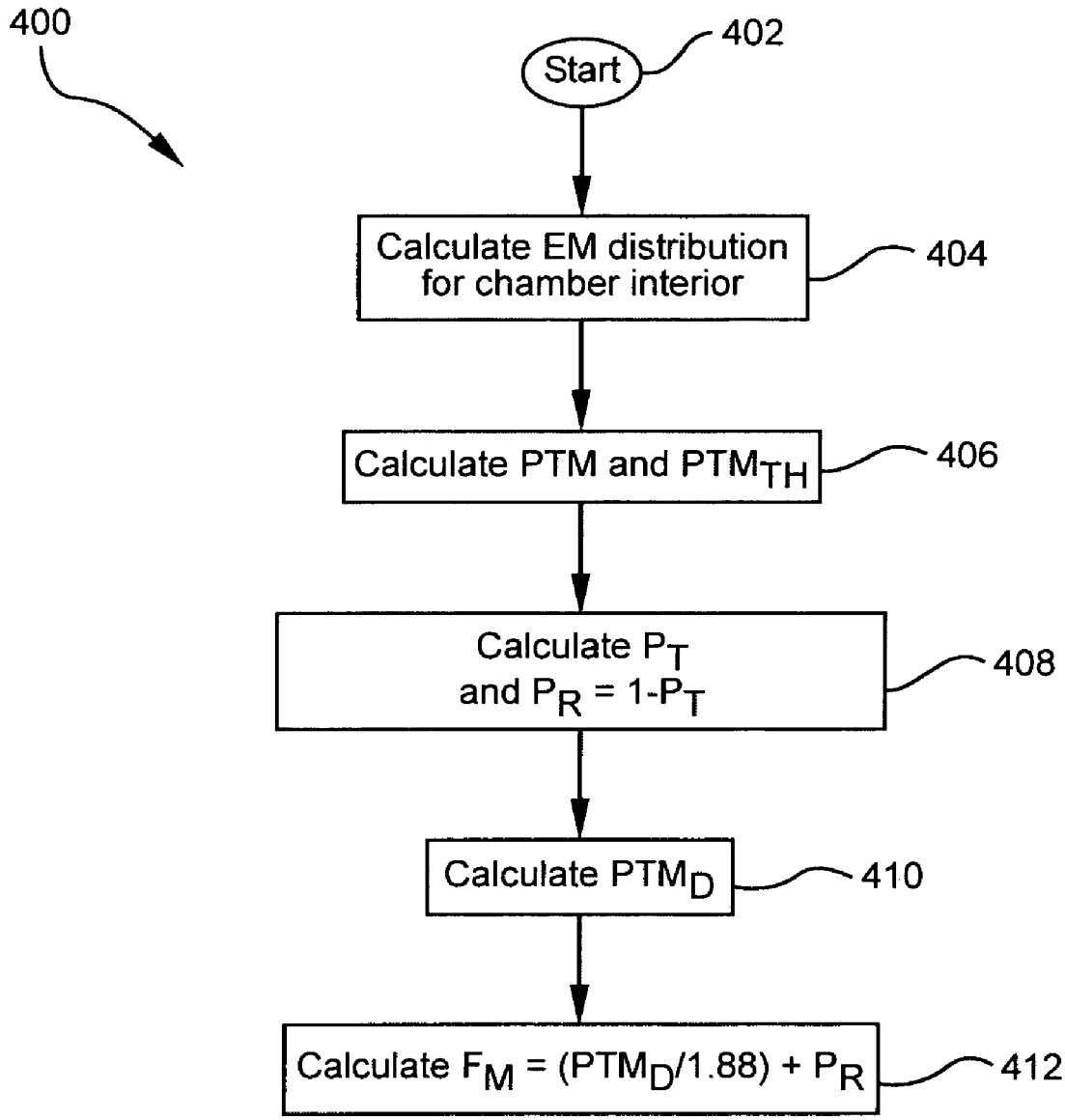
FIG. 14 is a flow diagram of an example embodiment of calculating the Figure of Merit $F_M$ in the flow diagram of FIG. 13.

FIG. 14 is a flow diagram 400 that illustrates an example embodiment of how the Figure of merit $F_M$ of step 310 in flow diagram 300 is calculated for each applicator system configuration. In step 402, all of the input parameters of flow diagram 300 are used to calculate the distribution of EM energy in oven interior 12. In an example embodiment, the calculation uses finite-difference time domain technique or other three-dimensional EM field solving technique used to solve Maxwell's equations. In this regard, there are a number of commercially available software programs such as XFDTD™, CST Microwave Studio™ or HFSS™.

In carrying out the computer simulation of the EM field distribution, the inventors used 1 W of input power for microwave radiation 270 generated by EM source 253 and inputted into input end 252 of feed waveguide 250. A portion of the input power is dissipated in the ware 10 and the rest is reflected. In the simulations, it can be assumed that any metallic surfaces are perfect electrical conductors (i.e., they do not represent a source of EM power loss). The result of step 404 is a 3D steady state EM field distribution within oven interior 212.

The next step 406 involves calculating a "plug-to-matrix" ratio PTM, which is defined as PTM=$\langle P_P\rangle/\langle P_M\rangle$, wherein $\langle P_P\rangle$ is the volume-weighted average of the amount of EM power dissipated in plugged ends 57A and 57B and $\langle P_M\rangle$ is the volume-weighted average of the amount of EM power dissipated in the matrix. For efficient drying of plugged ends 57A and 57B, this ratio should be as high as possible.

The theoretical maximum for PTM is $PTM_{TH}$ and is given by $PTM_{TH}=P_{PTH}/P_{MTH}$, wherein $P_{PTH}$ is calculated as the ratio of the heat capacity and heat of vaporization of water in the plugged areas vs. the heat capacity of the dry matrix material, $P_{MTH}$. Example theoretical values for $PTM_{TH}$ are 9.6, 13.1, and 16.8 for the first, second, and third matrix-plug combinations, respectively. The value of $PTM_{TH}$ should be always greater than 1.

The next step 408 involves calculating the total amount of EM power $P_T$ dissipated in the ware. This is obtained by a volume integration of the 3D power dissipations. This also yields the total reflected power $P_R=1-P_T$.

In the next step 410, the deviation of the calculated PTM versus the theoretical maximum $PTM_{TH}$ is calculated via the relationship $PTM_D=(PTM_{TH}-PTM)/PTM_{TH}$.

In the next step 412, the Figure of Merit $F_M$ is calculated via the relationship $F_M=\alpha(PTM_D)+P_R=(PTM_D/1.88)+P_R$ The values of $PTM_D$ and $P_R$ have equal influence on the Figure of Merit $F_M$. The only exception involves cases where $P_R>50\%$. From a practical viewpoint, such cases are excluded by setting $P_R=1$.

In an example embodiment, $1/\alpha$ is between about 1.8 and about 1.9. The value of $1/\alpha=1.88$ is derived from a worst case scenario corresponding to the Type3-Type A combination of matrix-plug material for ware 10 contributes a value of 0.5 to $F_M$. In other words, let the worst case PTM=1. Then $PTM_D=(16.8-1)/16.8=0.94$. To make $PTM_D=0.5$ (or a 50% contribution to $F_M$), one divides 0.94 by 1.88. Also in the worst case scenario, $P_R=0.5$ (or 3 dB). This means that the worst case $F_M=1$. In other words, $F_M$ should be less than 1 for efficient plug drying, and the smaller the value of $F_M$, the better is the associated applicator configuration for plug drying.

Figure 15:
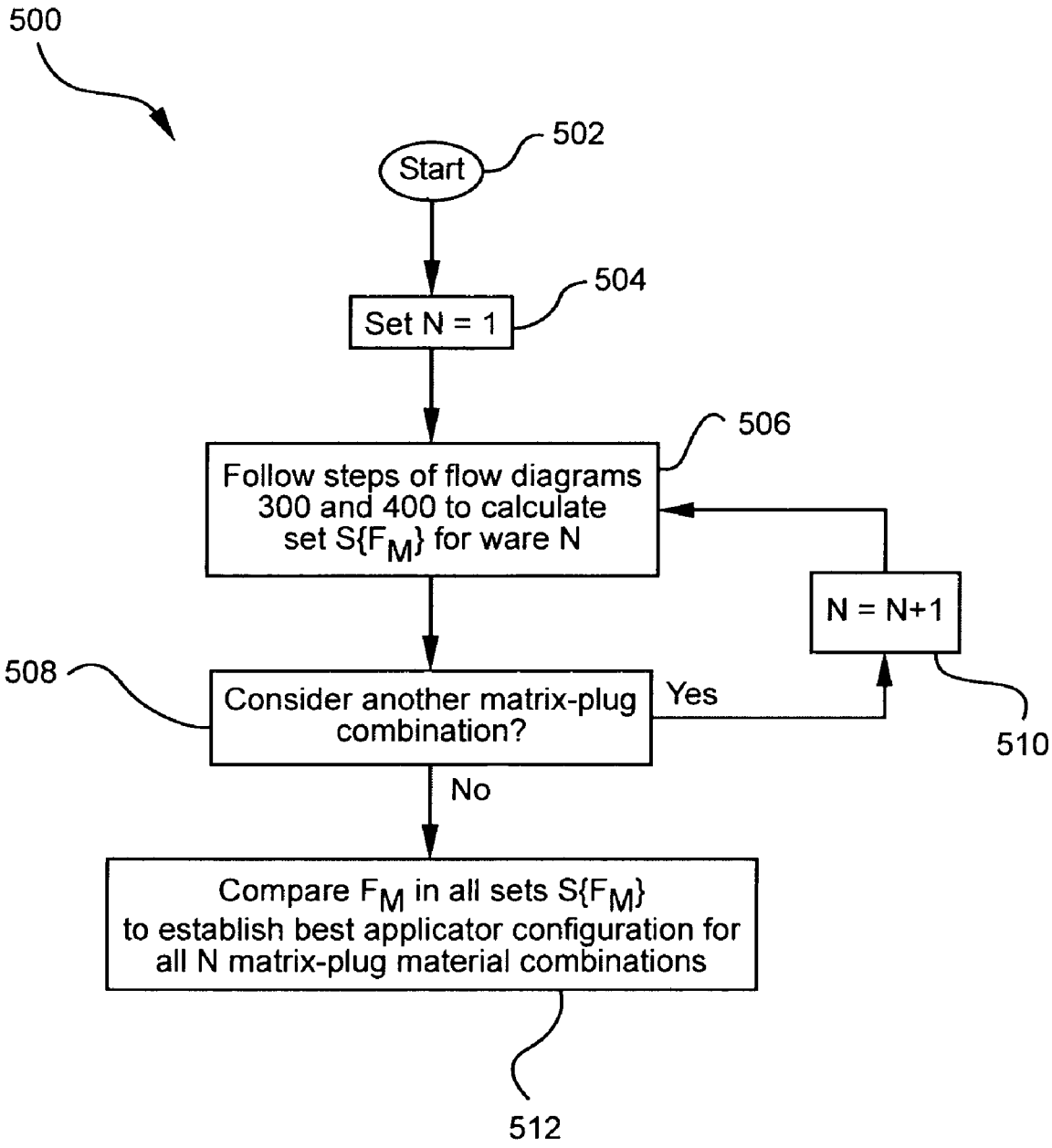
FIG. 15 is a flow diagram of an example embodiment of the method of using Figure of Merit calculations for setting the configurable applicator to dry wares having different matrix-plug material combinations.

FIG. 15 is a flow diagram 500 that illustrates an example embodiment of the method of the invention wherein the most efficient applicator configuration for plug drying is selected based on a number of different matrix-plug material combinations.

After an initial start step 502, the method proceeds to step 504 which sets integer N to N=1. The method then proceeds to step 506, which involves carrying out the methods outlined in flow diagram 300 of FIG. 13, wherein the different input parameters for ware N are identified and inputted in steps 304 and 306.

The methods of flow diagrams 300 and 400 are then carried out in step 506 to reach a first set $S_1\{F_M\}$ of Figure of Merits $F_M$ for the first matrix-plug combination (ware 1). The next step 508 asks whether a different combination of matrix-plug materials needs to be considered. If the answer is yes, then the method proceeds to step 510, which increments N by 1 and then returns to step 506, wherein the methods of flow diagrams 300 and 400 are repeated for a second (N=2) matrix-combination (ware 2). When enough sets (N sets) $S_1\{F_M\}$, $S_1\{F_M\}$, . . . $S_N\{F_M\}$ of Figures of Merit $F_M$ are obtained for the N different combinations of matrix-plug materials, then in step 512 the method compares the different values of $F_M$ in all N sets $S_1\{F_M\}$, $S_1\{F_M\}$, . . . $S_N\{F_M\}$ to determine whether there is a minimum value of $F_M$, thereby indicating an optimal applicator configuration for all N matrix-plug material combinations. Alternatively, the method inquires whether there is a configuration that correspond to a Figure of Merit below a certain threshold value TH (e.g., TH=0.5), as described above in connection with step 314 of flow diagram 300 (FIG. 13).

Simulation Results

Figure 16:
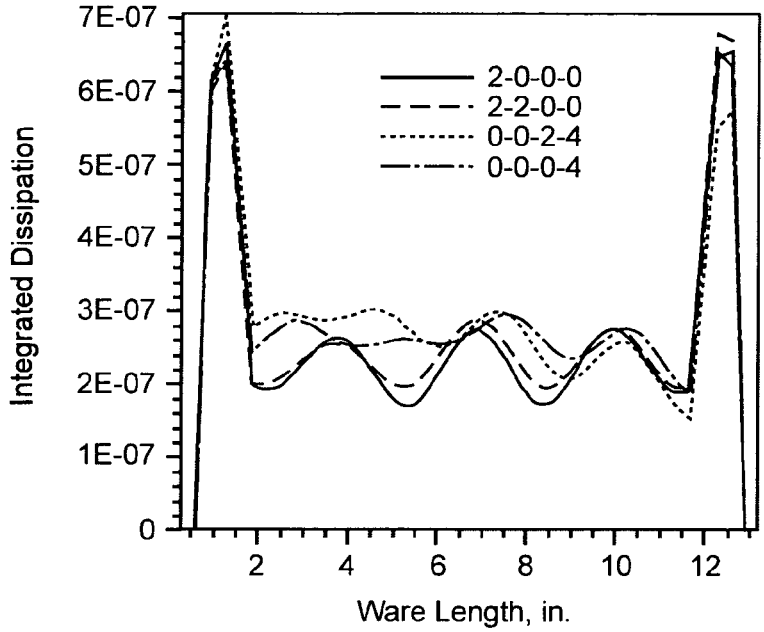
FIG. 16 is a computer simulation plot of the integrated power dissipation (ID) as a function of the axial ware length (inches) for four different slot configurations for a first ware matrix-plug material combination.
Figure 17:
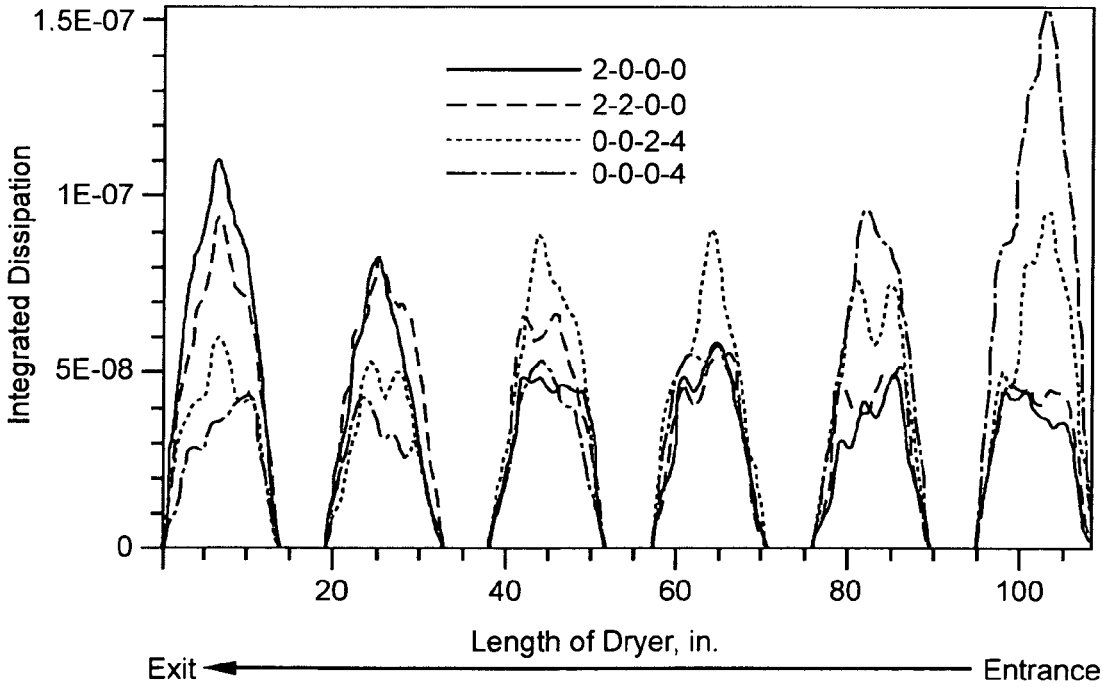
FIG. 17 is a computer simulation plot of the integrated power dissipation as a function of longitudinal position in the drying oven, illustrating the axial power dissipation distribution for the wares that travel through the drying oven interior for four different slot configurations for the first matrix-plug combination, and showing how the amount of EM radiation dissipated in the axial direction in each ware varies as a function of longitudinal position of the ware for the different slot configurations.

FIG. 16 is a plot of the integrated EM energy dissipation distribution ("Integrated Dissipation" ID) as a function of the axial position (in inches) along 10 as deduced by computer modeling for different slot configurations for applicator system 200 as discussed above. FIG. 17 plots the integrated dissipation ID as a function of the longitudinal position of each ware along conveyor path 242 also showing the axial ID for each ware. The matrix-plug composition used for the plots of FIGS. 16 and 17 is Type1-TypeA.

The amount of power provided to the ware along conveyor path 242 determines the heating and drying rates for the ware. By changing the configuration of slots 260, the ramp rates can be changed. Note that in FIG. 17 some of the slot configurations (e.g., 0-0-0-4) do not provide for significant ID at the ware ends corresponding to plugged ends 57A and 57B. On the other hand, slot configuration 2-2-0-0 provides for significant ID at the ware ends towards exit end 232 of oven interior 212.

Figure 18:
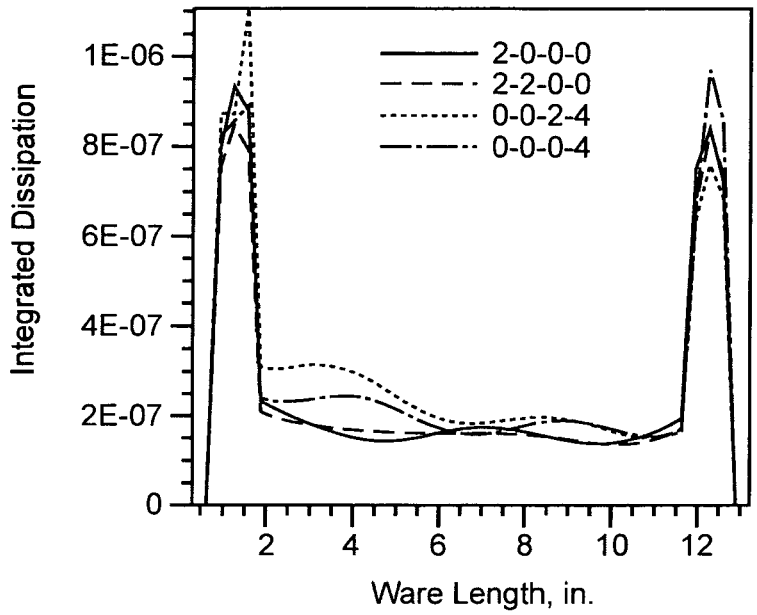
FIGS. 18 and 19 are the same as FIGS. 16 and 17, but for a second matrix-plug combination.
Figure 19:
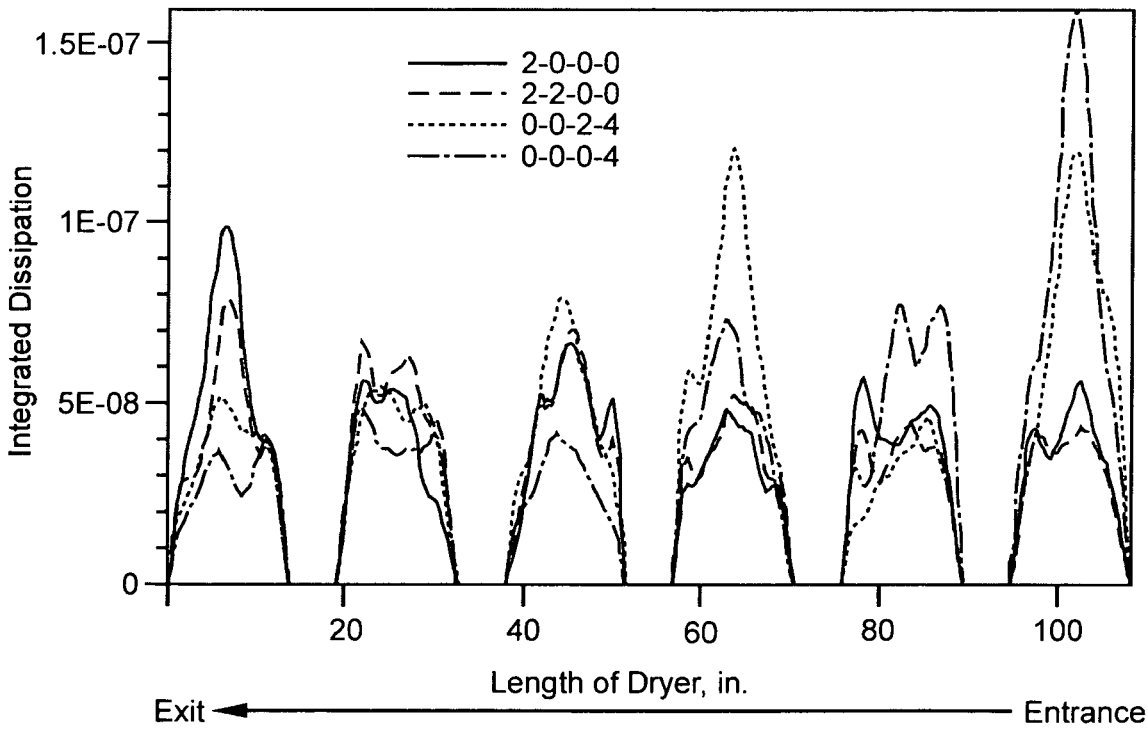

FIGS. 18 and 19 are similar to FIGS. 16 and 17 respectively except that matrix-plug composition was Type 2-Type B. Again, the 2-2-0-0 configuration appears to provide the most ID at the ware ends.

Figure 20:
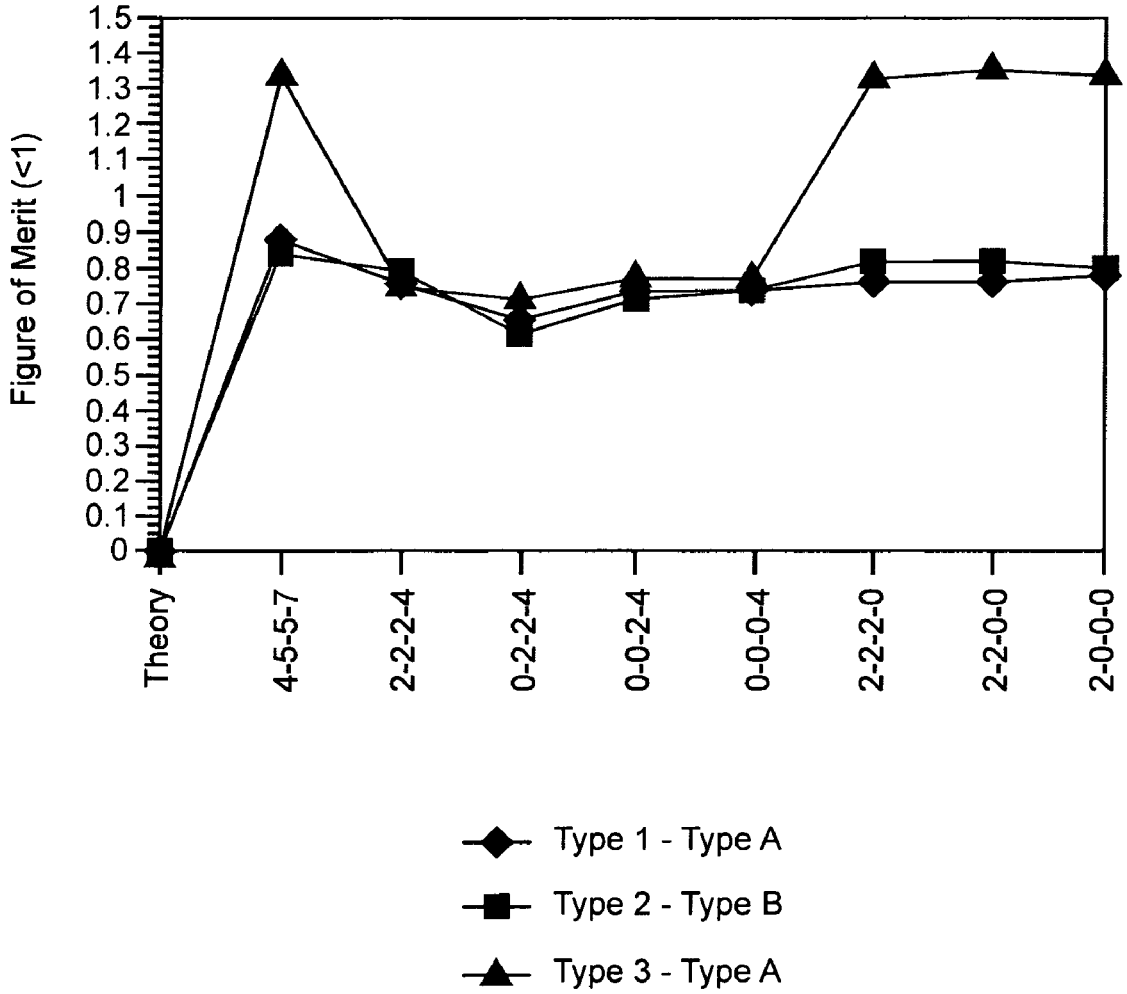
FIG. 20 is a computer-simulated plot of the Figure of Merit ($F_M$) vs. slot configuration for three different matrix-plug combinations, illustrating an example where a particular slot configuration has a Figure of Merit $F_M$ that corresponds to a configuration most efficient for drying the different types of wares.

FIG. 20 plots the Figure of Merit $F_M$ of applicator system 200 for a variety of different slot configurations and the first, second and third matrix-plug material combinations. Table 1 below lists the details of the parameters used for the calculation of the Figure of Merit plotted in FIG. 20.

| | PTM | $PTM_D$ | $P_R$ | $F_M = (PTM_d/1.88) + P_R$ |
|---|---|---|---|---|
| 1st Matrix-Plug Combination | | | | |
| THEORY | 9.6 | 0 | 0 | 0 |
| 4-5-5-7 | 2.29 | 0.761458333 | 0.45 | 0.855031028 |
| 2-2-2-4 | 2.45 | 0.744791667 | 0.35 | 0.74616578 |
| 0-2-2-4 | 2.2 | 0.770833333 | 0.21 | 0.62001773 |
| 0-0-2-4 | 2.27 | 0.763541667 | 0.31 | 0.716139184 |
| 0-0-0-4 | 2.38 | 0.752083333 | 0.31 | 0.710044326 |
| 2-2-2-0 | 2.52 | 0.7375 | 0.35 | 0.742287234 |
| 2-2-0-0 | 2.65 | 0.723958333 | 0.36 | 0.74508422 |
| 2-0-0-0 | 2.74 | 0.714583333 | 0.38 | 0.760097518 |
| 2nd Matrix-Plug Combination | | | | |
| | | | | 0.759042553 |
| THEORY | 13.1 | 0 | 0 | 0 |
| 4-5-5-7 | 3.65 | 0.721374046 | 0.44 | 0.823709599 |
| 2-2-2-4 | 3.3 | 0.748091603 | 0.37 | 0.767921065 |
| 0-2-2-4 | 3.07 | 0.765648855 | 0.18 | 0.587260029 |
| 0-0-2-4 | 3.07 | 0.765648855 | 0.29 | 0.697260029 |
| 0-0-0-4 | 3.84 | 0.706870229 | 0.34 | 0.715994803 |
| 2-2-2-0 | 3.77 | 0.71221374 | 0.42 | 0.798837096 |
| 2-2-0-0 | 4.06 | 0.690076336 | 0.43 | 0.797061881 |
| 2-0-0-0 | 4.06 | 0.690076336 | 0.41 | 0.777061881 |
| 3rd Matrix-Plug Combination | | | | |
| | | | | 0.767977911 |
| THEORY | 16.8 | 0 | 0 | 0 |
| 4-5-5-7 | 6.78 | 0.596428571 | **0.6 | **1.31724924 |
| 2-2-2-4 | 7.46 | 0.555952381 | 0.44 | 0.735719352 |
| 0-2-2-4 | 6.83 | 0.593452381 | 0.37 | 0.68566616 |
| 0-0-2-4 | 6.8 | 0.595238095 | 0.44 | 0.756616008 |
| 0-0-0-4 | 6.2 | 0.630952381 | 0.42 | 0.755612969 |
| 2-2-2-0 | 7.07 | 0.579166667 | **0.59 | **1.308067376 |
| 2-2-0-0 | 6.3 | 0.625 | **0.62 | **1.332446809 |
| 2-0-0-0 | 7.04 | 0.580952381 | **0.57 | **1.309017224 |

The data indicate that applicator configurations of either 0-2-2-4 or a 2-2-2-4 provide the best results for the three material compositions. A configuration with minimum value of $F_M$ for different material compositions is considered to provide the most efficient plug drying for wares 12 that pass through the applicator system. Note that those applicator configurations that have a Figure of Merit $F_M>1$ (as indicated by the asterisks) are considered unacceptable. This makes it very easy (and fast) to rule out certain applicator configurations that could otherwise take an undesirably long time to rule out empirically.

It will be apparent to those skilled in the art that various modifications to the preferred embodiment of the invention as described herein can be made without departing from the spirit or scope of the invention as defined in the appended claims. Thus, it is intended that the present invention covers the modifications and variations of this invention provided they come within the scope of the appended claims and the equivalents thereto.

What is claimed is:

1. A method for drying an article, the article comprising a honeycomb structure having a first end face, an opposing second end face, a longitudinal axis, and a plurality of axially extending cell channels, the method comprising the steps of:

inserting an inorganic ceramic-forming plug material into at least a subset of the cell channels at the first or second end face to form a plugged region of the honeycomb structure comprising a plurality of plugs, wherein the plugged region is axially adjacent to an unplugged region of the honeycomb structure;

conveying the honeycomb structure through an interior of a drying oven and along a conveyor path in a z-direction while the longitudinal axis of the honeycomb structure is oriented in an x-direction perpendicular to the z-direction; and directing EM radiation in a y-direction toward the honeycomb structure and between the first and second end faces, the y-direction being perpendicular to the x-direction and to the z-direction, and selectively subjecting the plugged region to more EM radiation than the unplugged region so that the EM radiation dissipated by the plugged region is greater than the EM radiation dissipated by the unplugged region.

2. The method of claim 1 wherein the honeycomb structure comprises an inorganic ceramic-forming material.

3. The method of claim 1 wherein the honeycomb structure comprises fired ceramic material.

4. A method for drying a ceramic-forming mixture, the method comprising the steps of:

providing a honeycomb structure having a first end face, an opposing second end face, a longitudinal axis and a plurality of axially extending cell channels;

inserting the ceramic-forming mixture into at least a subset of the cell channels at the first or second end face, thereby forming a plugged region of the honeycomb structure comprising a plurality of plugs of the ceramic-forming mixture, wherein the plugged region is axially adjacent to an unplugged region of the honeycomb structure; and directing EM radiation in a y-direction toward the honeycomb structure and between the first and second end faces, the y-direction being perpendicular to an x-direction of the longitudinal axis and to a z-direction of a conveying path, and selectively subjecting the plugged region to more EM radiation than the unplugged region so that the EM radiation dissipated by the plugged region is greater than the EM radiation dissipated by the unplugged region.

5. The method of claim 4 wherein the ceramic-forming mixture comprises an inorganic ceramic-forming material.

6. The method of claim 4 wherein the honeycomb structure comprises an inorganic ceramic-forming material.

7. The method of claim 4 wherein the honeycomb structure comprises fired ceramic material.

8. A method for drying of a ceramic honeycomb structure having a first end face, an opposing second end face, a longitudinal axis and a plurality of axially extending cell channels, with each cell channel having opposite first and second channel ends, the method comprising the steps of:

inserting a plug material into at least a subset of the first and second channel ends at the first or second end face to form a plurality of plugs that respectively constitute first and second plugged ends axially adjacent to a central unplugged region; and directing EM radiation in a y-direction toward the honeycomb structure and between the first and second end faces, the y-direction being perpendicular to an x-direction of the longitudinal axis and to a z-direction of a conveying path, and selectively subjecting the plugged region to more EM radiation than the unplugged region so that the EM radiation dissipated by the plugged region is greater than the EM radiation dissipated by the unplugged region.

9. The method of claim 8, wherein the plug material is an aqueous-based material.

10. The method of claim 8, wherein:

an amount of EM power absorbed by both plugged ends is $<P_P>$; and an amount of EM power absorbed by the unplugged central region is $<P_C>$ thereby defining a ratio $PTM=<P_P>/<P_C>$, wherein $PTM>1$.

11. The method of claim 10, including carrying out the method in an applicator having a drying oven with an EM power reflection $P_R$ and a plurality of configurable EM radiation sources that generate an amount of EM power $P_G$, and wherein $P_R/P_G<50\%$.

12. The method of claim 11, wherein the drying oven is adapted to accommodate the honeycomb structure with the longitudinal axis of the honeycomb structure oriented relative to a conveyor path therethrough, and further including:

defining a Figure of Merit $F_M$ as a linear function of the sum of PTM and $P_R$;

calculating $F_M$ for two or more plug-matrix material combinations; and configuring the configurable sources of EM radiation and/or the orientation of the honeycomb structure relative to the conveyor path to provide an axially non-uniform exposure of EM radiation that minimizes $F_M$ for said two or more plug-matrix material combinations.

13. The method of claim 12, wherein $F_M=\alpha(PTM_D)+P_R$, wherein $1/\alpha$ is in the range from about 1.8 to about 1.9, and $PTM_D$ is the ratio between a theoretical value for $PTM_{TH}$ and an actual value of PTM to $PTM_{TH}$.

14. The method of claim 8, including producing an axially non-uniform exposure of EM energy with a plurality of configurable sources of EM radiation.

15. The method of claim 14, further comprising: providing the configurable sources of EM radiation to include an EM feed waveguide having a plurality of slots that can be positioned relative to the conveying path or removed therefrom; and adjusting the non-uniform EM energy exposure by changing the positions of the slots relative to the conveying path and/or by removing at least one of the slots.

16. The method of claim 8, wherein the EM radiation has a frequency within at least one of the following ranges: from about 3 MHz to about infra-red (IR); from about 27 MHz to about 2.45 GHz; and from about 915 MHz to about 2.45 GHz.

17. A method for drying of at least one ceramic honeycomb structure having a longitudinal axis and plugged ends at opposing first and second endfaces axially adjacent to a central unplugged region, comprising the steps of:

providing a drying oven having an interior and a conveying path through the interior in a z-direction, the oven having associated therewith a plurality of adjustable EM radiation sources arranged along the conveying path, the EM sources each being configurable to direct EM radiation in a y-direction toward the honeycomb structure and between the first and second end faces, the y-direction being perpendicular to the x-direction of the longitudinal axis and to the z-direction of the conveying path; and while conveying each honeycomb structure along the conveying path in the z-direction, selectively subjecting the honeycomb structure to more EM radiation at the plugged ends than at the central unplugged region by directing EM radiation in a y-direction toward the honeycomb structure and between the first and second end faces so as to cause a greater amount of EM radiation dissipation by either of the plugged ends than by the central unplugged region.

18. The method of claim 17, including providing the plurality of configurable EM radiation sources as a corresponding plurality of configurable slots in an EM waveguide.

19. The method of claim 17, including configuring the slot positions relative to the conveying path so that relative amounts of EM radiation dissipated in the central unplugged region and the plugged ends vary along the conveying path.

20. The method of claim 1, further comprising providing an EM waveguide having a plurality of slots, the waveguide being disposed generally in an x-z plane and spaced away from the conveying path, wherein the EM radiation exits the slots in the y-direction.

21. The method of claim 20, wherein the x-z plane is oriented horizontally.

22. The method of claim 20, wherein at least a portion of the waveguide is serpentine.

* * * * *